US008531489B2

(12) United States Patent
Kasai et al.

(10) Patent No.: US 8,531,489 B2
(45) Date of Patent: Sep. 10, 2013

(54) DISPLAY APPARATUS HAVING MATRIX DISPLAY ELEMENTS

(75) Inventors: Naruhiko Kasai, Yokohama (JP); Hiroki Awakura, Yokohama (JP); Toshihiro Satou, Mobara (JP); Hajime Akimoto, Oume (JP)

(73) Assignees: Hitachi Display, Ltd., Chiba-Ken (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 1375 days.

(21) Appl. No.: 10/700,897

(22) Filed: Nov. 5, 2003

(65) Prior Publication Data

US 2004/0140968 A1 Jul. 22, 2004

(30) Foreign Application Priority Data

Nov. 5, 2002 (JP) ..... 2002-321346

(51) Int. Cl.
*G09G 5/10* (2006.01)

(52) U.S. Cl.
USPC ..... 345/690; 345/76; 345/204

(58) Field of Classification Search
USPC ..... 345/60–67, 74.1, 75.2, 76–82, 84–107, 345/204–215, 690–693; 315/169.3, 169.4
See application file for complete search history.

(56) References Cited

U.S. PATENT DOCUMENTS 6,016,037 A * 1/2000 Kuribayashi et al. ..... 315/169.3
6,169,532 B1 * 1/2001 Sumi et al. ..... 345/98
6,229,508 B1 * 5/2001 Kane ..... 345/82
6,340,867 B1 1/2002 Kang
6,384,804 B1 * 5/2002 Dodabalapur et al. ..... 345/82
6,392,620 B1 * 5/2002 Mizutani et al. ..... 345/88
7,184,480 B1 * 10/2002 Goetz et al. ..... 345/100
6,525,709 B1 * 2/2003 O'Callaghan ..... 345/98
6,753,834 B2 * 6/2004 Mikami et al. ..... 345/76
6,876,345 B2 * 4/2005 Akimoto et al. ..... 345/76
6,950,081 B2 9/2005 Akimoto et al.
7,015,884 B2 * 3/2006 Kwon ..... 345/78
7,050,024 B2 * 5/2006 LeChevalier ..... 345/84
7,053,890 B2 * 5/2006 Inukai ..... 345/211
7,071,906 B2 * 7/2006 Nishitani et al. ..... 345/81

(Continued)

FOREIGN PATENT DOCUMENTS

JP 2001-067043 A 3/2001
JP 2003-005709 A 1/2003
JP 2003-122301 A 4/2003
JP 2003-330422 A 11/2003

OTHER PUBLICATIONS

Akimoto. Hajime et al., An Innovative Pixel-Driving Scheme for 64-Level Gray-Scale Full-Color Active Matrix OLED Displays, SID 02 Digest, 2002, pp. 972-975.

*Primary Examiner* — Amare Mengistu
*Assistant Examiner* — Dmitriy Bolotin
(74) *Attorney, Agent, or Firm* — Antonelli, Terry, Stout & Kraus, LLP.

(57) ABSTRACT

A display apparatus comprises a self-luminous device display having a plurality of light emitting elements arranged in a matrix, a drive voltage generation circuit to generate a drive voltage signal for driving light emitting elements, a blanking period control-included data line drive circuit which controls the drive voltage either according to or irrelevantly to the display data, a scan line drive circuit to determine which light emitting elements to drive, and a pixel control circuit to control voltage written to pixels.

9 Claims, 12 Drawing Sheets

(56) References Cited

U.S. PATENT DOCUMENTS

| | | | | |
|---|---|---|---|---|
| 7,142,180 | B2 * | 11/2006 | Akimoto et al. | 345/76 |
| 7,145,532 | B2 * | 12/2006 | Kageyama et al. | 345/77 |
| 7,277,072 | B2 * | 10/2007 | Akimoto et al. | 345/76 |
| 7,286,105 | B2 | 10/2007 | Akimoto et al. | |
| 7,633,496 | B2 * | 12/2009 | Kasai et al. | 345/208 |
| 2002/0145602 | A1 * | 10/2002 | Matsueda | 345/213 |
| 2002/0149556 | A1 * | 10/2002 | Matsueda | 345/98 |
| 2005/0067968 | A1 * | 3/2005 | Yamashita | 315/167 |
| 2005/0212783 | A1 * | 9/2005 | Kasai et al. | 345/204 |
| 2011/0032282 | A1 * | 2/2011 | Kasai et al. | 345/690 |

* cited by examiner

DISPLAY APPARATUS HAVING MATRIX DISPLAY ELEMENTS

BACKGROUND OF THE INVENTION

The present invention relates to a display apparatus for displaying an image in Accordance with an input display data, the display apparatus being capable of controlling the brightness of each display element by the amount of applied current or the period of activation and, more particularly, to those employing light emitting diodes (LEDs), organic EL (Electro Luminescence) devices and other light emitting devices as display elements.

As flat panel type display apparatuses replace cathode ray tubes, a variety of display systems have been proposed. In particular, organic EL display apparatuses, electric field display (EFD) apparatuses, and plasma display devices have attracted attention as self-luminous display apparatuses. In "An Innovative Pixel-Driving Scheme for 64-Level Gray Scale Full-Color Active Matrix OLED Displays" (SID02 Proc.), a method is disclosed which controls the active time of each pixel by a signal voltage. In this method, after a signal voltage is written, a sweep voltage is applied through a switch within the pixel. In addition, a method for compensating for characteristics variations is disclosed in U.S. Pat. No. 6,229,508 (JP-A-11-219146). In this method, before a signal voltage is written to each pixel, a precharge voltage is applied through a switch formed within the pixel.

However, the method described in "An Innovative Pixel-Driving Scheme for 64-Level Gray Scale Full-Color Active Matrix OLED Displays" decreases the pixel's aperture ratio since a select switch and sweep voltage supply line are formed within each pixel. The method described in U.S. Pat. No. 6,229,508 also decrease the pixel's aperture ratio since a select switch and precharge voltage supply line are formed within each pixel.

SUMMARY OF THE INVENTION

It is an object of the present invention to raise each pixel's aperture ratio by reducing switches and wiring lines formed in the pixel in a display apparatus where a driver to supply a voltage (for example, a sweep voltage or precharge voltage) which is controlled irrelevantly to the input display data during one blanking period is provided for gray sale control or brightness nonuniformity compensation.

According to the present invention, a data line drive circuit to output a drive voltage according to the input display data is provided with a circuit which sets the data lines to voltage levels controlled irrelevantly to the input display data during the blanking period. For example, the data drive circuit is designed to output gray scale voltages according to the input display data when input display data is present and is designed to output a sweep voltage during the blanking period in which the input display data is not present.

According to the present invention, a data line drive circuit to output a drive voltage according to the input display data is provided with a circuit which sets the data lines to voltage levels controlled irrelevantly to the input display data during the blanking period so that the data line drive circuit can control voltage levels of the data lines during the blanking period irrelevantly to the input display data. Thus, it is possible to provide a low manufacture cost display apparatus where the aperture ratio is raised by simplifying the control circuits and wiring lines in the display area.

Needless to say, the present invention is not limited to the claimed configurations and the preferred embodiments described later and various modifications are possible without departing from the technical idea of the present invention.

DETAIL DESCRIPTION OF THE PREFERRED EMBODIMENTS OF THE INVENTION

The following describes the embodiments of the present invention with reference to the drawings. Note that a display apparatus is sometimes denoted as a display below.

First Embodiment

Figure 1:
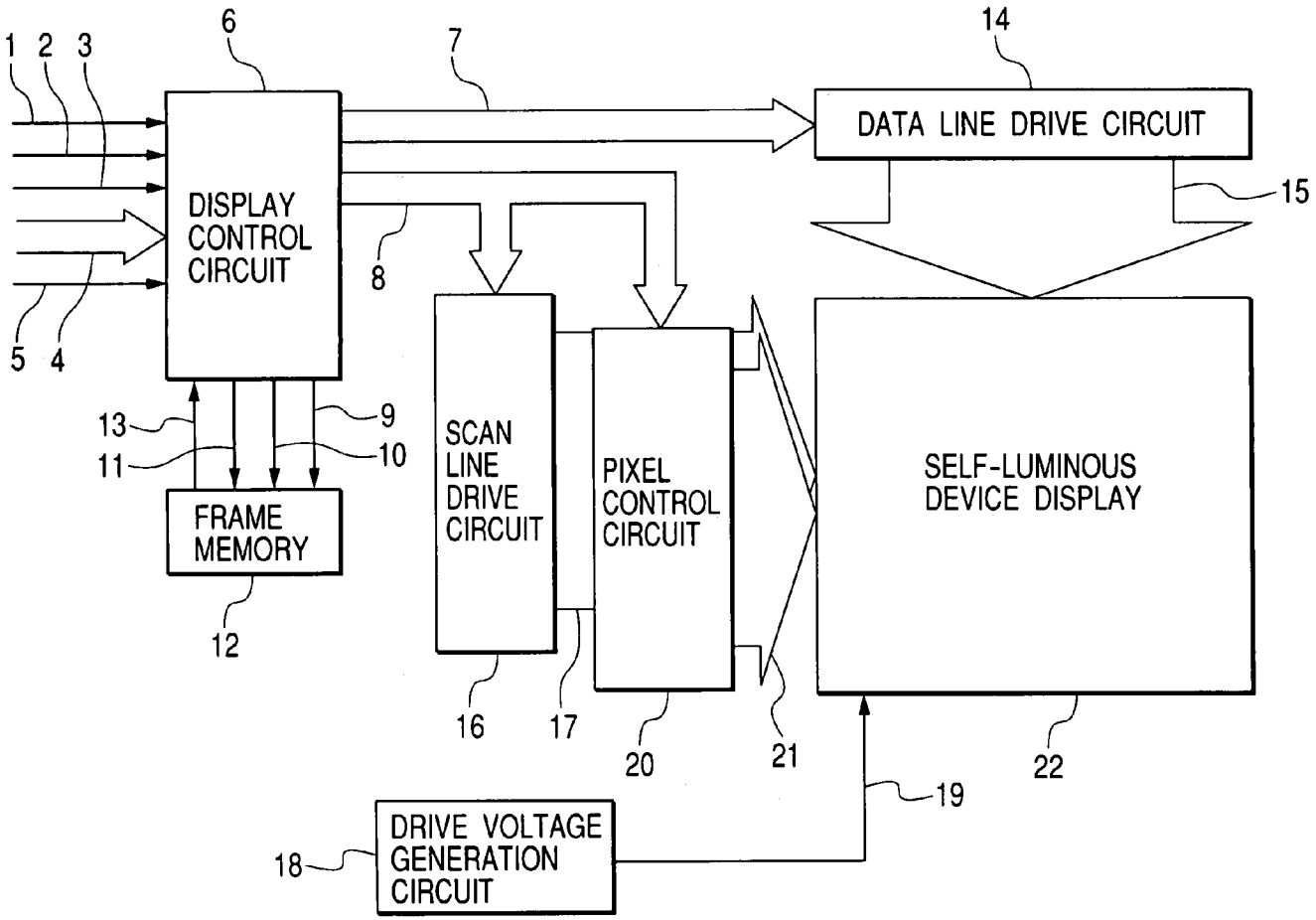
FIG. 1 is a block diagram to explain the system configuration of a first embodiment of a display apparatus of the present invention.

FIG. 1 is a block diagram for explaining the system configuration of a first embodiment of a display apparatus of the present invention. In FIG. 1, reference numeral 1 is a vertical synchronizing signal, 2 is a horizontal synchronizing signal, 3 is a data enable signal, 4 is display data (either moving or still picture data), and 5 is a synchronizing clock. The vertical synchronizing signal 1 defines each display screen period (1-frame period), the horizontal synchronizing signal 2 defines each horizontal scan period, and the data enable signal 3 defines a period during which display data is enabled (display enabled period). These signals are all provided in synchronization with the synchronizing clock 5.

It is assumed in the description of the first embodiment that the display data is sequentially transferred frame by frame in a raster scan format starting from the top left corner and each pixel's information comprises 6 bits of gray scale data. Reference numeral 6 is a display control circuit, 7 is a set of data line control signals, 8 is a set of scan line control signals, 9 is a store/read command signal, 10 is a store/read address, 11 is store data, 12 is a frame memory, and 13 is frame readout data.

The display control circuit 6 generates the store/read command signal 9, store/read address 10 and store data 11 in order to temporally store display data 4 in the frame memory 12 capable of storing at least one-frame display data 4 for a self-luminous device display (described later).

In addition, the store/read command signal 9 and store/read address 10 are generated so as to read one-frame display data in step with the display timing of the self-luminous device display. The frame memory 12 stores store data 11 or reads out frame readout data 13 according to the store/read command 9 and store/read address 10. The display control circuit 6 generates the data line control signal 7 and scan line control signal 8 from the frame readout data 13. Reference numeral 14 is a data line drive circuit, 15 is a data line drive signal, 16 is a scan line drive circuit, 17 is a scan line drive signal, 18 is a drive voltage generation circuit, 19 is a light emitting device drive voltage, 20 is a pixel control circuit, 21 is a data write control signal, and 22 is a self-luminous device display.

Here, the self-luminous device display 22 refers to any of displays which use such display elements as light emitting diodes and organic EL devices. The self-luminous device display 22 has a plurality of light emitting elements (pixel structures) which are arranged in a matrix, i.e., formed respectively where a number of scan lines intersect with a number of data lines. For display on the self-luminous device display 22, signal voltages according to the data line drive signal 15 output to the data lines from the data line drive circuit 14 are applied to pixels connected to scan lines selected by the scan line drive signal 17 output from the scan line drive circuit 16 and written to the pixels according to the pixel control signal 21 output from the pixel control circuit 20 and then a sweep voltage is applied to the pixels. According to the scan line control signal 8, the pixel control circuit 20 outputs the data write control signal 21 to control the timing of writing data to pixels. The voltage to drive the light emitting elements is supplied as the light emitting device drive voltage 19. Note that the scan line drive circuit 16 and pixel control circuit 20 may either be implemented as a single LSI or formed on the glass substrate where the pixel structures are formed.

It is assumed in the description of the first embodiment that the self-luminous device display 22 has a resolution of 240 by 320 dots. The self-luminous device display 22 can adjust the brightness of each light emitting element by the amount of current flowing through the light emitting element and the on-time of the light emitting element. As the amount of current flowing through a light emitting element increases, the brightness of the light emitting element rises. Likewise, lengthening the on-time of a light emitting element raises the brightness. According to the display data, the data line drive circuit 14 generates signal voltages which are respectively written to light emitting elements. Then, the data line drive circuit 14 generates and outputs a sweep voltage which controls the on-time of each light emitting element according to the signal voltage written to the light emitting element.

Figure 2:
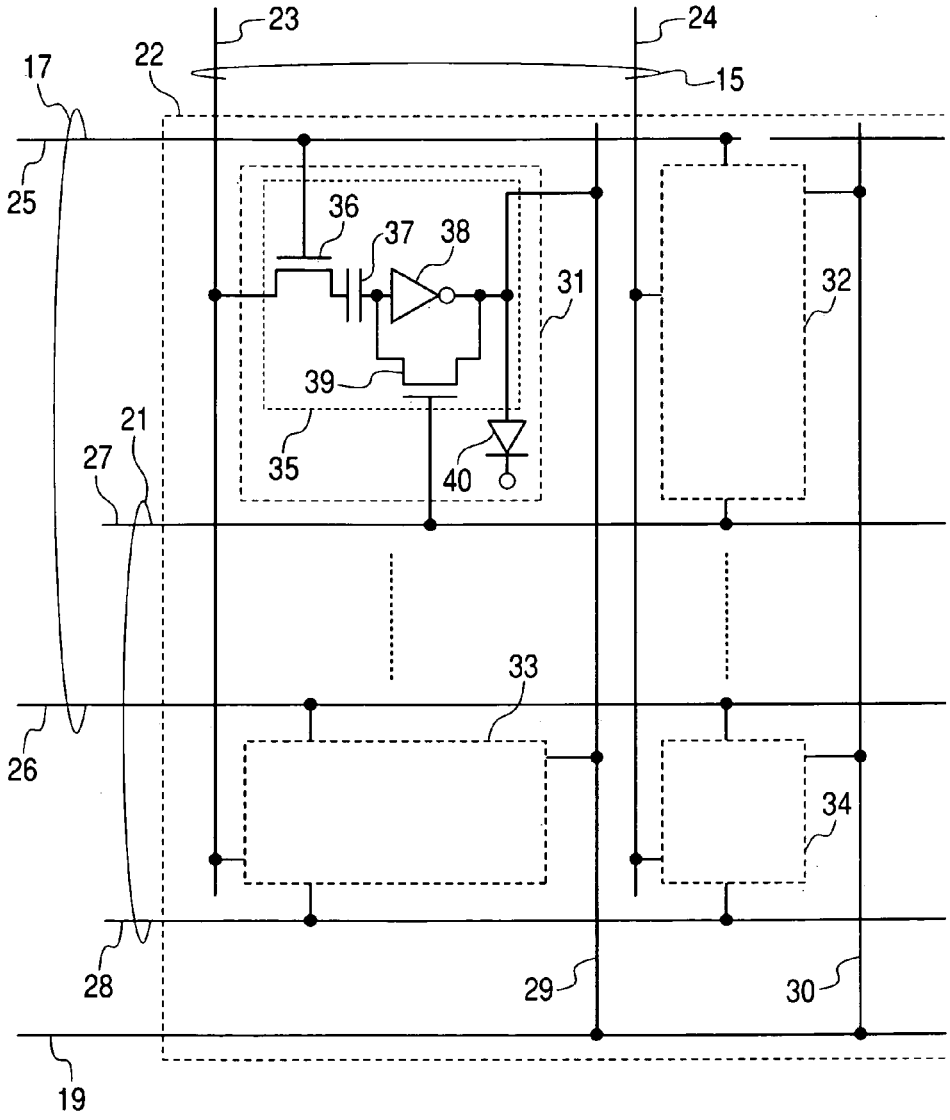
FIG. 2 is a diagram used to explain the internal configuration of the self-luminous device display shown in FIG. 1.

FIG. 2 is a diagram for explaining the pixel configuration within the self-luminous device display 22. In this example, organic EL elements are used as the light emitting elements. In FIG. 2, reference numeral 23 is the first data line, 24 is the second data line, 25 is the first scan line, 26 is the 320th scan line, 27 is the first write control line, 28 is the 320th write control line, 29 is the first column organic EL drive voltage supply line, 30 is the second column organic EL drive voltage supply line, 31 is a pixel in the first row and first column, 32 is a pixel in the first row and second column, 33 is a pixel in the 320th row and first column, and 34 is a pixel in the 320th row and second column. To the pixels in a row selected by the scan line and write control line, signal voltages and a sweep voltage are supplied via the respective data lines. Each pixel's on-time during which the pixel is activated by the organic EL drive voltage supplied from the organic EL drive line of the column is controlled by the signal voltage and sweep voltage.

Although the internal configuration of only the pixel 31 in the first row and first column is shown here, the pixel 32 in the first row and second column, the pixel 33 in the 320th row and first column, and the pixel 34 in the 320th row and second column are also configured in the same manner. Reference numeral 35 is a pixel drive block, 36 is a switching transistor, 37 is a write capacitor, 38 is a drive inverter, 39 is a write control switch, and 40 is an EL element. The pixel drive block 35 controls the on-time of the EL element 40 based on the signal voltage. The pixel drive block 35 comprises the switching transistor 36, write capacitor 37, drive inverter 38 and write control switch 39. The switching transistor 36 is turned on by the first scan line 25 and the write control switch 39 is turned on by the first write control line 27.

If the write control switch 39 is turned on, the input and output of the drive inverter 38 are short-circuited. This establishes a reference voltage according to the characteristics of the transistor constituting the drive inverter 38. The write capacitor 37 is charged by the signal voltage of the first data line 23 relative to this reference voltage. After write is done, a sweep voltage is entered. While the voltage of the sweep voltage is higher than the signal voltage to which the write capacitor 37 is charged, the organic EL 40 is off. While the voltage is lower, the organic EL 40 is on. The on-time of the organic EL 40 is controlled according to the signal voltage in this manner.

Since the self-luminous device display 22 has 240 by 320 pixels as mentioned earlier, 320 horizontal lines consisting of the first scan line 25 through the 320th scan line 26 are vertically distributed, whereas 240 vertical lines consisting of the first data line 23 through the 240th data line are horizontally distributed. Further, the organic EL drive voltage supply lines are formed on the bottom side of the self-luminous device display 22. Here, it is assumed that 240 organic EL drive voltage supply lines (such as the first organic EL drive voltage supply line 29 and second organic EL drive voltage supply line 30) in the vertical direction (column direction) are distributed in the horizontal direction (row direction).

Figure 3:
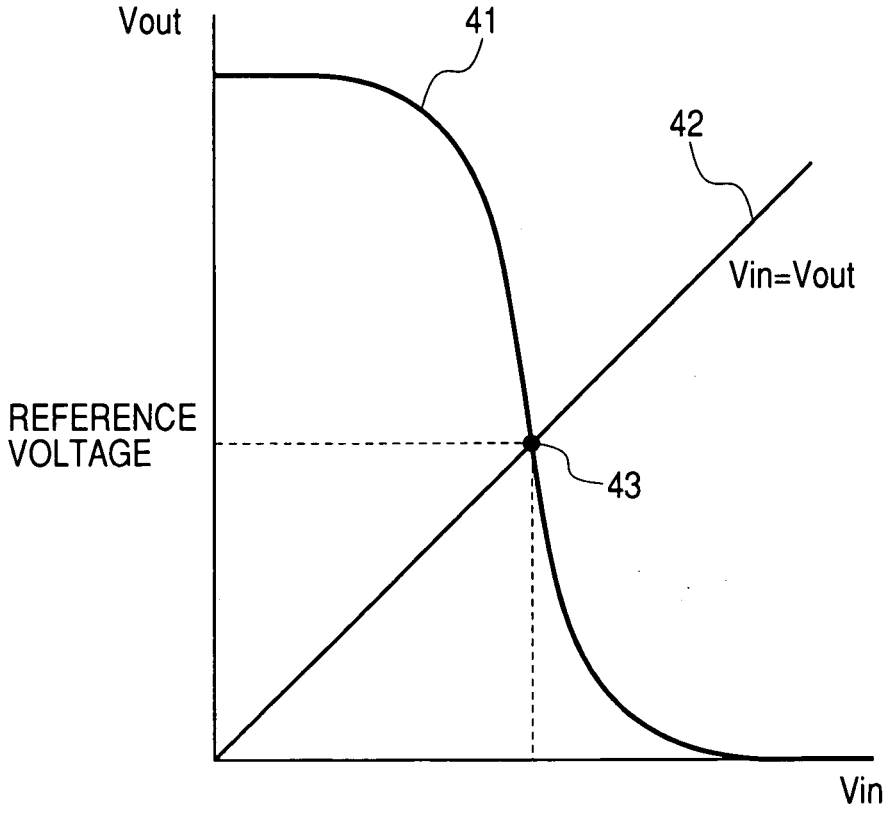
FIG. 3 is a diagram used to explain how a reference voltage is established in a drive inverter for the signal voltage shown in FIG. 2.

FIG. 3 is a diagram used to explain how a reference voltage is established at the drive inverter 38 for the signal voltage in FIG. 2. In FIG. 3, a curve 41 is the input output characteristic of the drive inverter 38 and a straight line 42 shows the condition that the input is short-circuited with the output. A point 43 of intersection of the curve 41 and straight line 42 shows a reference voltage established at the drive inverter 38 when the signal voltage is written. Since its input and output are short-circuited when data is written, the input/output voltage of the drive inverter 38 is set to the point 43 of intersection of the input output characteristic 41 and the Vin=Vout straight line 42 representing the input output short-circuit condition. Write is done by the signal voltage relative to this write reference voltage 43.

Figure 4:
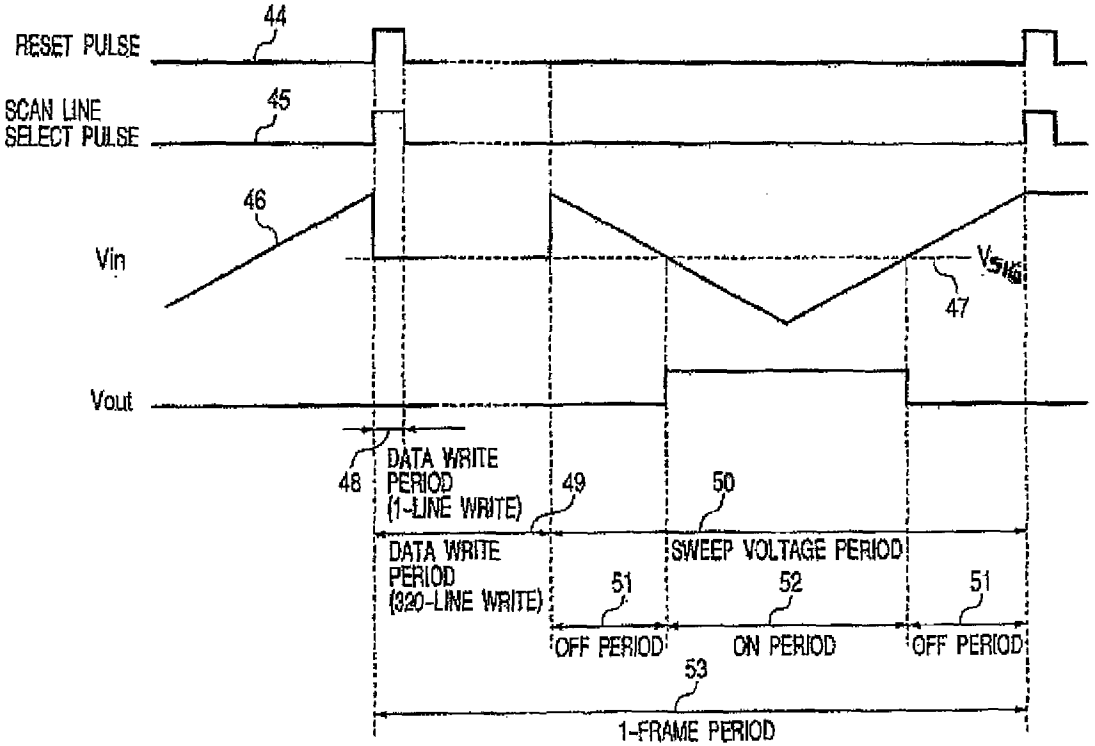
FIG. 4 is a timing chart to explain how the on-time is controlled by a written signal voltage and a sweep voltage.

FIG. 4 is a timing chart for explaining how the-on-time is controlled by the written signal voltage and a sweep voltage. In FIG. 4, reference numeral 44 is a write control pulse, 45 is a scan line select pulse, 46 is the input of the drive inverter, 47 is the threshold voltage of the drive inverter, 48 is a 1-line data write period, 49 is a data write period, 50 is a sweep voltage period, 51 is an off-time period, 52 is an on-time period, and 53 is a 1-frame period. The write control pulse 44 turns on the write control switch 39 of FIG. 2 to set the signal voltage write reference voltage 43 shown in FIG. 3. Simultaneously, the scan line select pulse 45 turns on the switching transistor 36 of FIG. 2 so that the signal voltage is written into the write capacitor 37 via the first data line 23 relative to the signal voltage write reference voltage 43. The written voltage Vsig becomes the threshold voltage 47 of the drive inverter 38.

The drive inverter input 46 is an input waveform to one drive inverter. During the 1-line data write period 48, signal voltages according to the display data are also input respectively to the other drive inverters connected to the same scan line. During the other 1-line data periods of the data write period 49, signal voltages are also written respectively by the corresponding scan lines. After the data write period 49 is complete, a sweep voltage is applied to the drive inverter input 46 during the sweep voltage period 50. While the sweep voltage level is higher than the drive inverter threshold voltage 47, the output of the drive inverter 38 is "0". While the sweep voltage level is lower than the drive inverter threshold voltage 47, the output of the drive inverter 38 is "1". Thus, power supply to the organic EL 40 is in the "off" state during the off period 51. Likewise, power supply to the organic EL 40 is in the "on" state during the on period 52. This means that the light emitting period is determined according to the signal voltage. The data input and sweep voltage input are done periodically at a fixed frequency. In the description of the present embodiment, it is assumed that they are done once respectively in the 1-frame period 53 which corresponds to a frequency of 60 Hz.

Figure 5:
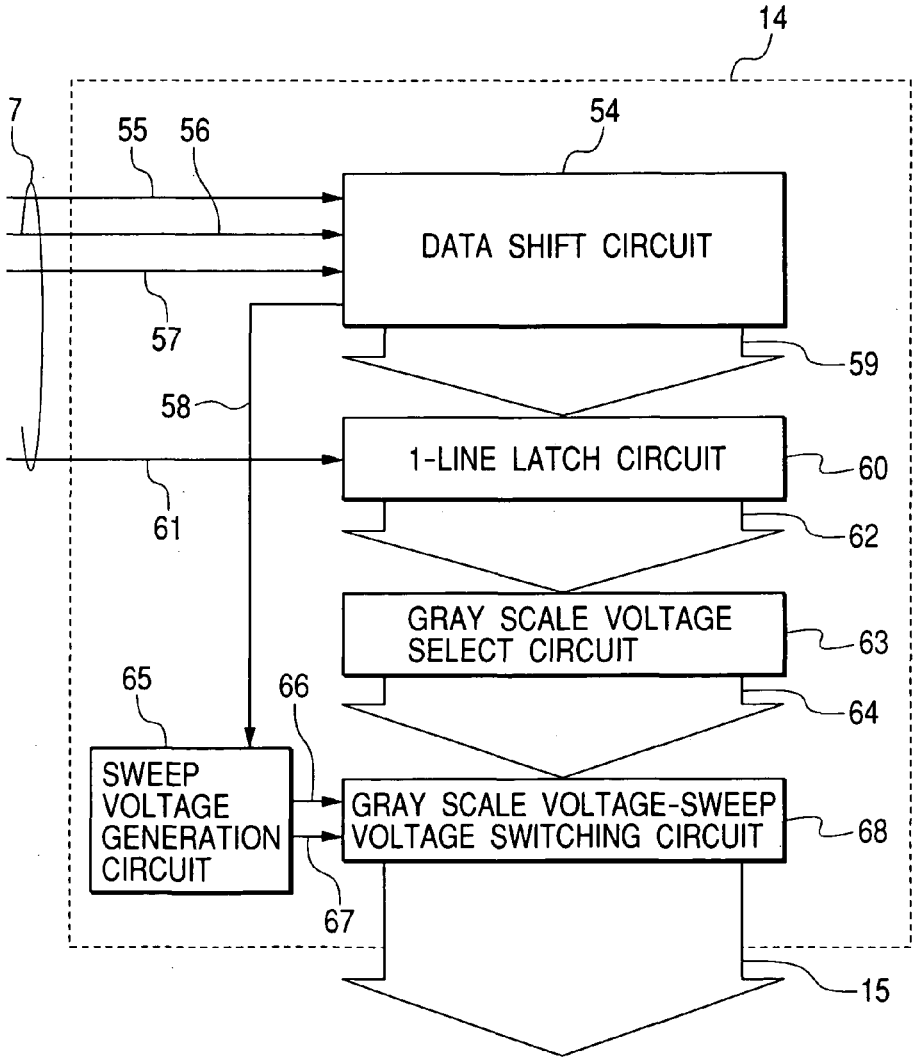
FIG. 5 is a block diagram to indicate an internal configuration of the blanking period control-included data line drive circuit shown in FIG. 2.

FIG. 5 is the block diagram of an internal configuration of the data line drive circuit 14 shown in FIG. 1. In FIG. 5, reference numeral 54 is a data shift circuit, 55 is a data start signal, 56 is a data clock, 57 is display input serial data, 58 is a blanking period signal, and 59 is shift data. Triggered by the data start signal 55 in synchronization with the data clock 56, the data shift circuit 54 takes in one-line display input serial data 57 during one horizontal period and outputs the. latched data as shift data 59. Reference numeral 60 is a one-line latch circuit, 61 is a horizontal latch clock, and. 62 is one-line latch data. The one-line latch circuit 60 latches in one-line shift data 60 and outputs the data as one-line latch data 62 in synchronization with the horizontal latch clock 61. Reference numeral 63 is a gray scale voltage select circuit and 64 is one-line display data.

The gray scale voltage select circuit 63 selects one level from 64-level gray scale voltages for each pixel according to the one-line latch data 62 and outputs the result as one-line display data 64. As described, the one-line display data 64 is generated from the data line control signals 7 in the same manner as conventional. Reference numeral 65 is a sweep voltage generation circuit, 66 is a sweep voltage signal, and 67 is a sweep voltage select signal. The sweep voltage generation circuit 65 not only generates and outputs a sweep voltage 66 independent of the input display data according to the blanking period signal 58 but also generates the sweep voltage select signal 67 indicating that the sweep voltage is output to the data line. Reference numeral 68 is a gray scale voltage-sweep voltage switching circuit which selects the one-line display data 64 or sweep voltage 66 and outputs the selected one as the data line drive signal 15.

Figure 6:
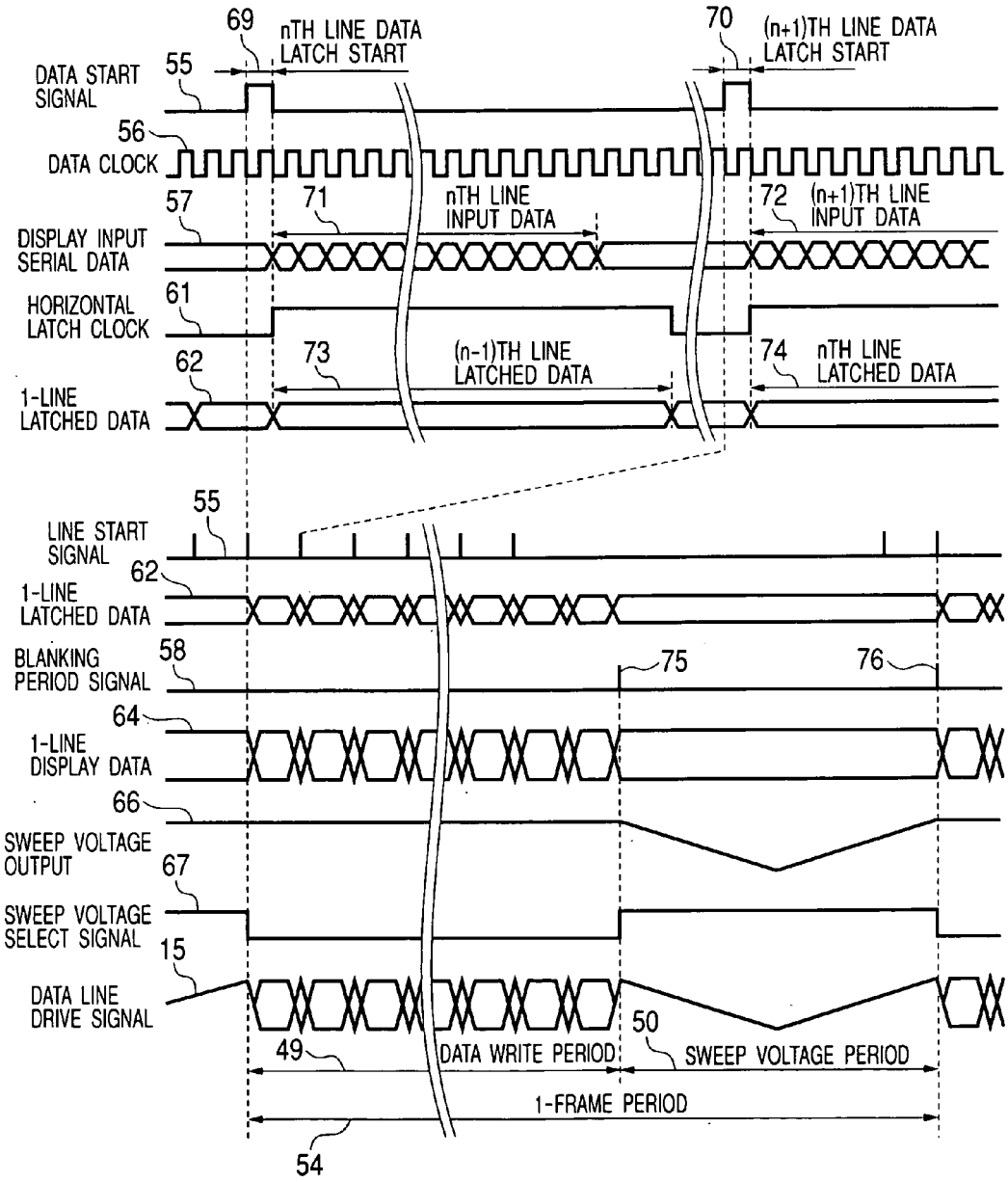
FIG. 6 is a timing chart to explain the operation of the blanking period control-included data line drive circuit shown in FIG. 5.

FIG. 6 is a timing chart to explain how the data line drive circuit 14 of FIG. 5 operates. In FIG. 6, reference numeral 69 is the nth line data start timing, 70 is the (n+1)th line start timing, 71 is the nth line display input serial data, 72 is the (n+1)th line display input serial data, 73 is the (n−1)th line latch data, and 74 is the nth line latch data. The display input serial data 57 begins to be taken in by the shift clock 56 when the data start signal 55 is "1". For example, the nth line display input serial data 71 begins to be taken in at the first rising edge of the shift clock 56 during the nth line data start timing period 69. After one-line data is all taken in, the horizontal latch clock 61 rises to indicate that the one-line latch data 62 is output. For example, the nth line display input serial data 71 is output as the nth line latch data 74 at the first rising edge of the horizontal latch clock 61 after the data is all taken in.

Below in FIG. 6, the above-mentioned timing chart is expanded in the time axis. Reference numeral 75 is the input display data end timing and 76 is the input display data start timing. The input display data end timing 75 is the timing when the blanking period signal 59 goes "1" after all one-line latch data 62 are output, that is, the 320th one-line latch data 62 is output. The input display data start timing 76 is the timing when the blanking period signal 59 goes "1" at the end of the blanking period before the first one-line latch data 62 is output. Between the input display data end timing 75 and the input display data start timing 6, there lies a blanking period where a sweep voltage 66 is output but any one-line latch data 62 and one-line display data 64 are not output. The data line drive signal 15 selects one-line display data 64 when the sweep voltage select switch 67 is "0", i.e., one-line display data 64 is selected during a data write period 49. When the sweep voltage select signal 67 is "1", i.e., during a sweep voltage period 50, a sweep voltage 66 is selected.

Figure 7:
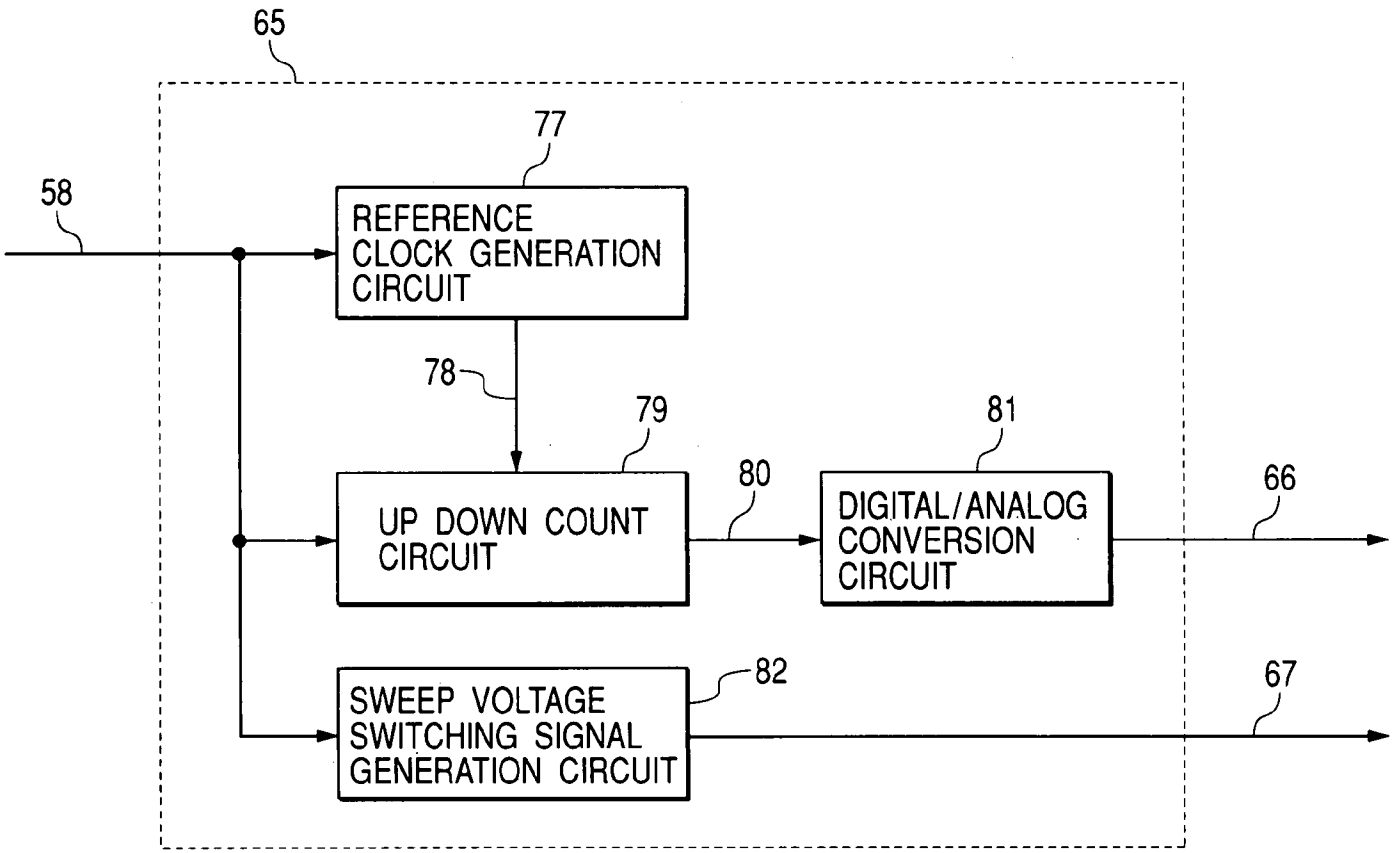
FIG. 7 is a block diagram to indicate an internal configuration of the sweep voltage generation circuit shown in FIG. 5.

FIG. 7 is a block diagram to explain an internal configuration of the sweep voltage generation circuit 65 shown in FIG. 5. In FIG. 7, reference numeral 77 is a reference clock generation circuit, 78 is a reference clock, 79 is an up down count circuit, 80 is a count output, 81 is a digital/analog conversion circuit, and 82 is a sweep voltage select signal generation circuit. The reference clock generation circuit 77 generates the reference clock 78 used to generate a sweep voltage 66. In synchronization with the reference clock 78, the up down count circuit 79 counts down from an initial value to "0" and counts up to the initial value while outputting the count output 80. The digital/analog conversion circuit 81 converts the digital count output 80 to an analog output and outputs it as the sweep voltage 66. It is assumed in the description of the present embodiment, the up down count circuit 79 is a 6-bit counter, the counter's initial value is "63" and the digital/analog conversion circuit 81 supports 6-bit digital data.

Figure 8:
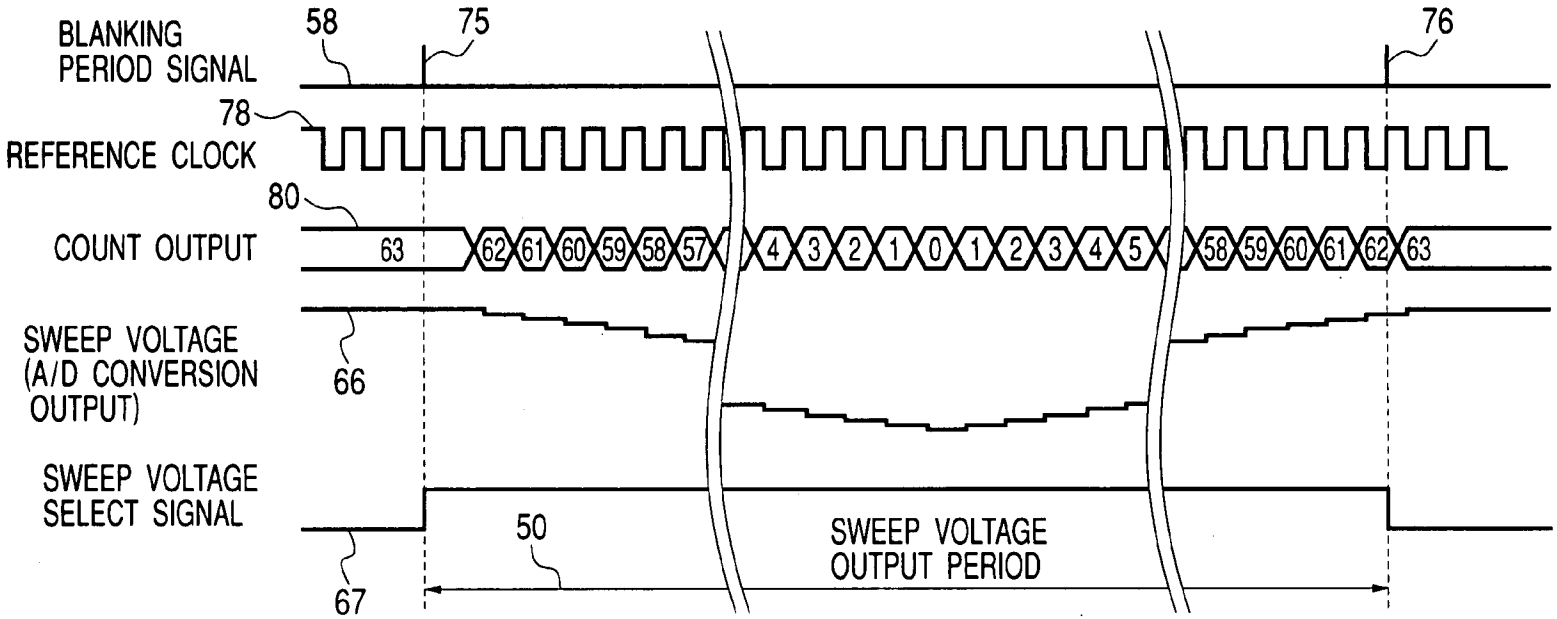
FIG. 8 is a timing chart to explain how the reference clock generation circuit, up down count circuit and digital/analog conversion circuit of FIG. 7 operate.

FIG. 8 is a timing chart to explain how the reference clock generation circuit 77, up down count circuit 79 and digital/analog conversion circuit 81 of FIG. 7 operate. In FIG. 8, the reference clock 78 includes at least as many cycles as required by the up down circuit 79 to count down from the initial value "63" to "0" and count up to "63" again during a sweep voltage period 50 between the input display data end timing 75 and the input display data start timing 76. In synchronization with the reference clock 78, the count output 80 counts down from the initial value "63" to "0" and counts up to "63" again. The count output 80 is 6-bit digital data representing "0" through "63". The sweep voltage signal 66 is generated by converting the count output 80 to an analog value in such a manner that it has the lowest level when the count output 80 is "0" and has the highest level when the count output 80 is "63".

Referring to FIGS. 1 through 8, the following describes how the sweep voltage control is performed during a blanking period in the present embodiment. Firstly, let us describe the flow of display data with reference to FIG. 1. In FIG. 1, the display control circuit 6 temporally stores one-frame display data 4 in the frame memory 12 as store data 11. Then, consistent with the display timing of the self-luminous device display 22, the display control circuit 6 reads out the display data as read data 13 from the frame memory 12 and generates the data line drive signals 7 and scan line control signals 8. Usually, the frame memory 12 is used either when the input display data 4 is different in resolution from the self-luminous device display 22 or when the blanking period must be adjusted to allow such special processing as done in the present embodiment. If the input resolution is completely identical to the resolution of the self-luminous device display 22 and the blanking period is enough long, the frame memory 12 may be omitted.

The data line drive circuit 14 latches in the data line drive signals 7 for one line (or plural lines), including 6-bit gray scale information, and converts them to signal voltages for the corresponding pixels of the self-luminous device display 22 as well as generating a sweep voltage during a blanking period. The signal voltages and sweep voltage are output as the data line drive signal 15 as described later in detail. The scan line drive circuit 16 outputs the scan line drive signal 17 so that the scan lines of the self-luminous device display 22 are sequentially selected. The drive voltage generation circuit 18 generates an organic EL drive voltage 19 which serves as a reference for generating a drive voltage to turn on organic EL elements. The pixel control circuit 20 generates data write control signals 21 to control the write control switch provided in each pixel of the self-luminous device display 22 on an each line basis as described later in detail. Finally, pixels of the self-luminous device display 22 which are connected to the scan line selected by the san line drive signal 17 and data write control signal 21 are activated according to the signal voltages, sweep voltage signal and organic EL drive voltage 19.

The following describes in detail how the self-luminous device display 22 of FIG. 1 is activated with reference to FIGS. 2 through 4. Referring to FIG. 2, if the write control switch 39 is turned on via the first write control line 27, an intermediate voltage between the input voltage and output voltage of the drive inverter 38 is set as the signal voltage write reference voltage 43 according to the characteristic shown in FIG. 3 since the input of the drive inverter 38 is short-circuited with the output. If a scan line select voltage is applied via the first scan line 25 at this time, the switching transistor 36 is turned on to charge the write capacitor 37 by the data signal voltage via the first data line 23 relative to signal voltage write reference voltage 43. The resulting voltage will serve as the threshold voltage 47 of the drive inverter as shown in FIG. 4.

In FIG. 2, the drive inverter 38 outputs "0" while the input voltage is higher than the threshold voltage and "1" while the input voltage is lower than the threshold voltage. Therefore, if a sweep voltage is entered via the first data line, the drive inverter 38 outputs "0" during the off period 51 while the voltage level of the sweep voltage is higher than the drive inverter threshold voltage 47 and "1" during the on period 52 while the voltage level is lower than the threshold voltage as shown in FIG. 4. In FIG. 2, the organic EL 40 is in the off state while the output of the drive inverter 38 is "0" and in the on state while the output is "1". When the organic EL 40 is in the on state, the organic EL 40 emits light due to the drive current which flows through it according to the organic EL drive voltage 19. As described, gray scale representation is done by controlling the on/off time according to the signal voltage. Note that although a CMOS transistor is usually used to configure the drive inverter 38 which is depicted here by a logical circuit symbol, the drive inverter 38 may be configured anyway as far as it has such a characteristic as shown in FIG. 3.

With reference to FIGS. 5 and 6, the following describes in detail how the driver 14 operates to output the sweep voltage signal 66 during the blanking period. In FIG. 5, the data shift circuit 54 latches in input display serial data 57 and outputs it as shift data 59 according to the data start signal 55 and data clock 56. Started according to the data start signal 55, the input display serial data 57 is taken in one by one at each rising edge of the data clock 56 as shown in FIG. 6. The one-line latch circuit 60 of FIG. 5 latches in the shift data 59 from the data shift circuit 54 according to the horizontal latch clock 61 and outputs it as one-line latch data.

As shown in FIG. 6, the one-line latch data 62 is output at the rising edge of the horizontal latch clock 61. The gray scale voltage select circuit 63 of FIG. 5 selects one level from 64 gray scale voltage levels for each pixel according to the corresponding six bits of the one-line latch data 62 and outputs the result as one-line display data 64. Referring to FIG. 6, the gray scale level of each one-line display data 64 output during the data write period 49 varies according to the display data. The sweep voltage generation circuit 65 generates the sweep voltage signal 66 and sweep voltage select signal 67 according to the blanking period signal 58. As shown in FIG. 6, the sweep voltage signal 66 falls to the lowest level from the highest level and rises again to the highest level during the sweep voltage period 50 and the sweep voltage select signal 67 is "1" during the sweep voltage period 50. They are described later in detail.

The gray scale voltage-sweep voltage select circuit 68 of FIG. 5 selects either one-line display data 64 or the sweep voltage signal 66 according to the sweep voltage select signal 67 and outputs the selected one as the data line drive signal 15. As shown in FIG. 6, one-line display data 64 is selected during the data write period 49 when the sweep voltage select signal 67 is "0" and the sweep voltage signal 66 is selected during the sweep voltage period 50 when the select signal is "1", so that the data line drive signal 15 is provided. The data line drive circuit is implemented in this manner so as to output the sweep voltage signal during each blanking period.

With reference to FIGS. 7 and 8, the following describes in detail how the sweep voltage signal 65 is generated by the sweep voltage generation circuit 65 described with FIG. 5. The reference clock generation circuit 77 of FIG. 7 generates a reference clock 78 according to the blanking period signal 58 as shown in FIG. 8. The reference clock 78 includes at least as many cycles as required to count down to "0" from "63" and count up to "63" again between the input display data end timing 75 and input display data start timing 76 of the blanking period signal 58. Such a number of cycles may be obtained either by generating the corresponding fixed frequency from a quartz oscillator or by using a register or the like to vary the frequency. It is also possible to use a PLL to generate a frequency-fixed clock as the reference clock 78 between the input display data end timing 75 and input display data start timing 76 which are indicated by the reference signal. Note that before and after each sweep voltage period 50, it does not matter at what frequency the reference clock 78 operates, that is, the reference clock 78 may be either operated continuously or stopped.

The up down count circuit 79 of FIG. 7 performs counting according to the blanking period signal 58 and reference clock 78. As shown in FIG. 8, the up down count circuit 79 sets the initial count value "63" at the input display data end timing of the blanking signal 58 to begin counting down in synchronization with the reference clock 78. If the count value reaches "0", the up down count circuit 79 is switched to perform count up until the count value reaches again to the initial value "63". Each count value is output as the count output 80. Although the count output 80 changes step by step in both count up and down operations in the present embodiment, this step width may be designed to be variable so as to allow change the shape of the sweep voltage. In addition, the count values are not limited to 6-bit values "0" through "63".

The digital/analog conversion circuit 81 of FIG. 7 converts the 6-bit count output 80 to a 64-level analog signal. As shown in FIG. 8, the obtained analog signal is output as the sweep voltage signal 66 which has the highest level when the count output 80 is "63" and the lowest level when the count output 80 is "0". The sweep voltage select signal generation circuit 82 of FIG. 7 outputs the sweep voltage select signal 67 which continues to be "1" between the input display data end timing 75 and input display data start timing 76 of the blanking period signal 58, as shown in FIG. 8. Although the count output 80 is 6 bits long, the embodiment can also be configured in such a manner that the count output is converted to a serial output before input to the digital/analog conversion circuit 81 in order to reduce the number of lines.

The sweep voltage signal 66 and sweep voltage select signal 67 are generated from the blanking period signal 58 as described above. Although a sweep voltage signal is generated digitally from the counter output in the present embodiment, the sweep voltage signal can be replaced by any signal which rises and/or falls during the blanking period. It is also possible to modify the configuration so as to output a fixed voltage level in addition to a sweep voltage as the data drive signal during the blanking period, which allows application to a drive system where precharge is must be done during the blanking period.

According to the first embodiment of the present invention, discussed so far, since the data line drive signal during the blanking period is controlled by a data line drive circuit irrelevantly to the input display data, voltage control (sweep voltage in the embodiment) for the blanking period can be selected outside the pixels, whereas in prior art systems, such voltage control is selected through switches formed within pixels. This makes it possible to simplify the pixel circuit and reduce control lines in the panel.

Second Embodiment

Figure 9:
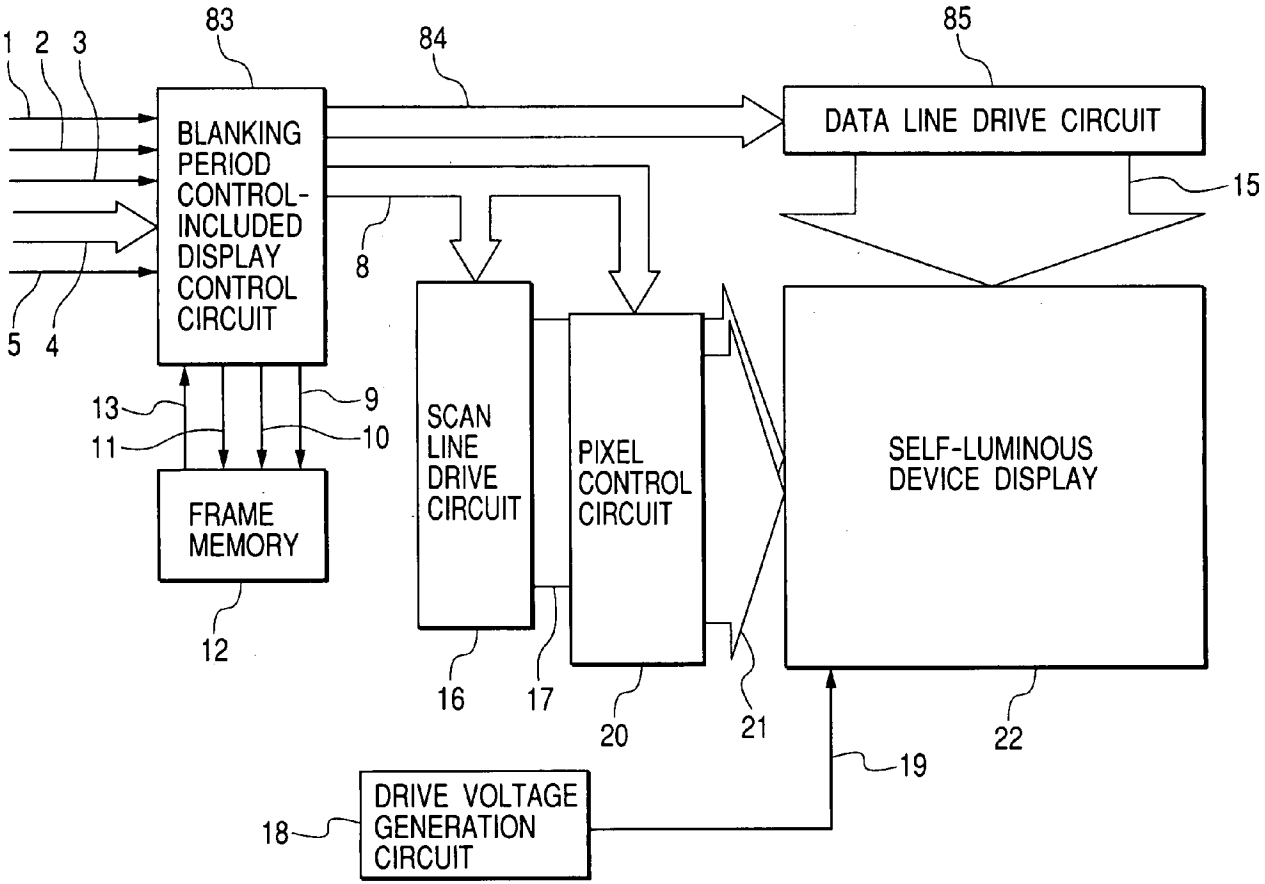
FIG. 9 is a block diagram to explain the system configuration of a second embodiment of a display apparatus of the present invention.
Figure 10:
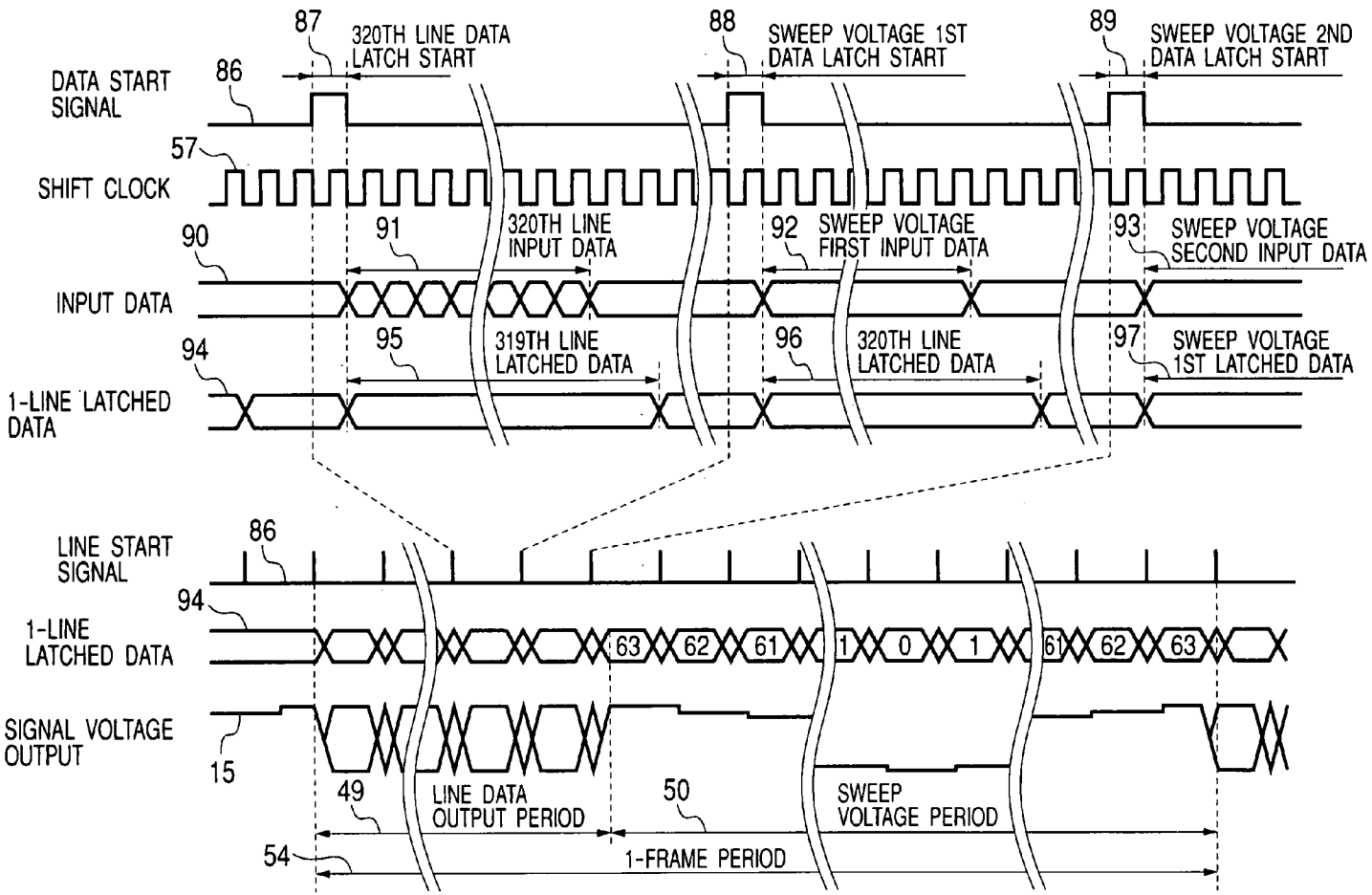
FIG. 10 is a timing chart to explain the operation of the blanking period control-included display control circuit shown in FIG. 9.

The following will describe a second embodiment of the present invention in detail with reference to FIG. 9 and FIG. 10. FIG. 9 is a block diagram to explain the system configuration of the second embodiment of a display apparatus of the present invention. In FIG. 9, reference numeral 1 is a vertical synchronizing signal, 2 is a horizontal synchronizing signal, 3 is a data enable signal, 4 is display data, and 5 is a synchronizing clock. They are all identical to the corresponding ones of the first embodiment. Reference numeral 83 is a blanking period control-included display control circuit, 84 is a set of blanking period control-included data line control signals, 8 is a set of scan line control signals, 9 is a store/read command signal, 10 is a store/read address, 11 is store data, 12 is a frame memory and 13 is frame readout data. Similar to the first embodiment, the blanking period control-included display control circuit 83 not only generates the scan line control signals 8, store/read command signal 9, store/read address 10, and store data 11 similar to the first embodiment but also generates the blanking period control-included data line control signals 84 to control the operation of the data line drive circuit 85 during the blanking period as described later. The store circuit 12 operates in the same manner as in the first embodiment.

Reference numeral 85 is the data line drive circuit, 15 is a data line drive signal, 16 is a scan line drive circuit, 17 is a scan line drive signal, 18 is a drive voltage generation circuit, 19 is an organic EL drive voltage, 20 is a pixel control circuit, 21 is data write control signals, and 22 is a self-luminous device display. Unlike in the first embodiment, the data line drive circuit 85 generates the data line drive signal 15 according to an input control signal in the same manner as conventional. The others are all identical to those in the first embodiment.

FIG. 10 is a timing chart to explain the operation of the blanking period control-included display control circuit 83 shown in FIG. 9. In FIG. 10, reference numeral 86 is the blanking period control-included data start signal, 87 is the 320th line data start timing, 88 is the sweep voltage first data start timing, 89 is the sweep voltage second data start timing, 90 is blanking period control-included display data, 91 is the 320th line input display data, 92 is the sweep voltage first input data, 93 is the sweep voltage second input data, 94 is the blanking period control-included one-line latch data, 95 is the 319th line latch data, 96 is the 320th line latch data, and 97 is the sweep voltage first latch data.

The blanking period control-included data start signal 86 provides sweep voltage data start timings such as the sweep voltage first data start timing 88 and sweep voltage second data start timing 89 in order to signal the start of each data for generating a sweep voltage during the blanking period in addition to each input display data start timing such as the 320th line data start timing 87. The corresponding data start signal in the first embodiment provides only input display data start timings. It is assumed that there are provided the first through 127th sweep voltage start timings in the second embodiment. The blanking period control-included display data 90 includes data for generating a sweep voltage during the blanking period, such as the sweep voltage first input data 92 and sweep voltage second input data 93, in addition to input display data such as the 320th line input display data 91. The corresponding data in the first embodiment includes only input display data.

It is also assumed that there are provided the first through 127th sweep voltage input data. The blanking period control-included one-line latch data 94 includes sweep voltage first latch data for generating a sweep voltage during the blanking period in addition to input display one-line latch data such as the 319th line latch data 95 and 320th line latch data 96. The corresponding one-line latch data in the first embodiment includes only input display one-line latch data. It is also assumed that there are provided the first through 127th sweep voltage latch data in the second embodiment. Below in FIG. 10, the timing chart is expanded in the time axis. As the blanking period control-included one-line latch data 94, the sweep voltage first one-line latch data 97 has "63" and the subsequent two sweep voltage one-line latch data respectively have "62" and "61". This value decrements to "0" one by one and then increments one by one again to "63" of the sweep voltage 127th latch data. Since the signal voltage output 15 has one of the 64 voltage levels corresponding to "0" through "63", the signal voltage output 15 has a stepped waveform during the sweep voltage period 54.

The following describes the sweep voltage control during the blanking period in the second embodiment with reference to FIG. 9 and FIG. 10. Firstly, let us describe the flows of the display data in FIG. 10. Similar to the first embodiment, in FIG. 9 the blanking period control-included display control circuit 83 temporally stores display data 4 in the frame memory 12 and reads out the display data from there consistent with the display timing of the self-luminous device display 22. Unlike in the first embodiment, however, it generates the blanking period control-included data line control signals which include input data to be used to generate a sweep voltage signal during the blanking period. The scan line control signals 8 are generated in the same manner as in the first embodiment.

Similar to the first embodiment, the data line drive circuit 85 latches in the data line drive signals 84 for one line (or plural lines), including 6-bit gray scale information, converts them to signal voltages, and outputs the signal voltages as the data line drive signal 15 for the corresponding pixels of the self-luminous device display 22. Since the blanking period control-included data line control signals 84 include data for generating a sweep voltage signal, however, the data line drive circuit 85 outputs a sweep voltage signal during the blanking period of the data line drive signal 15 as described later in detail. The scan line drive circuit 16, drive voltage generation circuit 18, pixel control circuit 20, and self-luminous device display 22 operate in the same manner as in the first embodiment.

Referring to FIG. 10, the following describes in detail how the blanking period control-included display control circuit 83 of FIG. 9 operates to generate the blanking period control-included data line control signals 84 for generating a sweep voltage signal. In FIG. 10, the blanking period control-included data start signal 86 goes "1" not only to signal the 320th line data start timing 87 like a conventional data start signal but also to signal the sweep voltage first data start timing 88, sweep voltage second data start timing 89, . . . and sweep voltage 127th data start timing. In step with these sweep voltage data start timings, the blanking period control-included display data 90 generates display data during the blanking period irrelevantly to the input display data.

For example, the sweep voltage first input data 92 carries 6-bit data "63" for 240 dots per line, the sweep voltage second input data 93 carries 6-bit data "62" for 240 dots per line, the sweep voltage 64th input data carries 6-bit data "0" for 240 dots per line, the sweep voltage 65th input data carries 6-bit data "1" for 240 dots per line, and the sweep voltage 127th input data carries 6-bit data "63" for 240 dots per line. Since the signal voltage output 15 selects one level from the 64 levels for each pixel according to the corresponding 6-bit data, gray scale voltage levels are output according to the input display data 4 during the data write period 49, whereas a stepped signal waveform is output during the sweep voltage period 50. Note that although the sweep voltage input data includes the first through 127th data which changes in steps of 1 in the embodiment, it is possible not only to increase (or decrease) the number of input data from 127 but also to change the step width from 1 in order to control the form of the sweep voltage. The data line drive circuit 85 outputs a sweep voltage during the blanking period as described so far.

The second embodiment of the present invention is advantageous over the first embodiment in that the modified display control circuit 6 makes it possible to use a prior art data line drive circuit.

Figure 11:
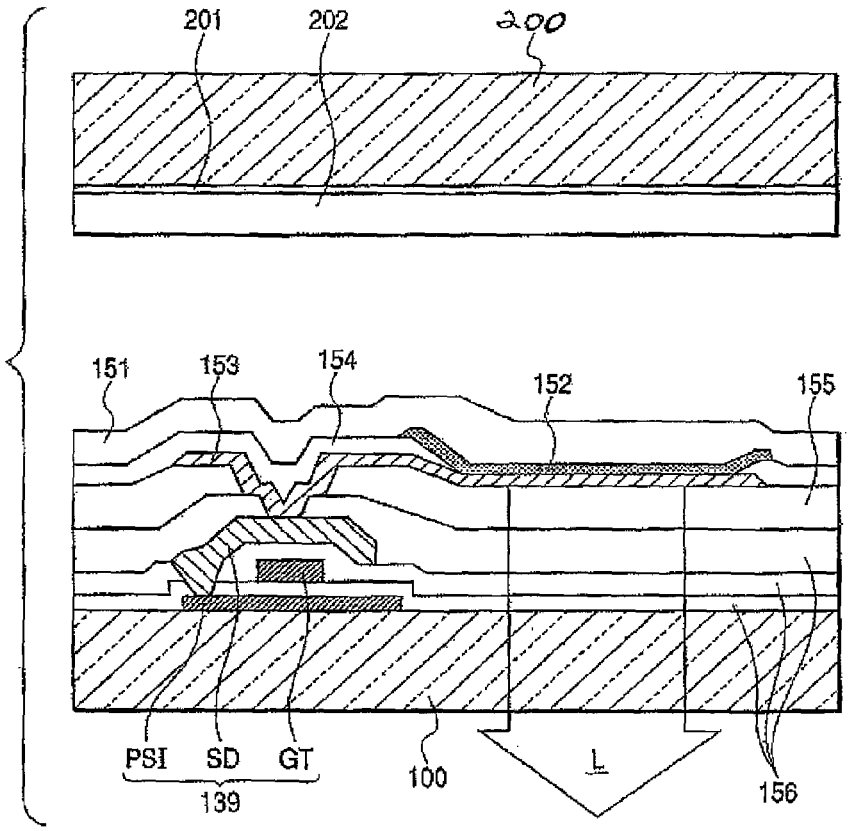
FIG. 11 is a schematic sectional view to explain a major portion of a pixel structure in an organic EL display apparatus where the present invention is applied.

FIG. 11 is a schematic sectional view depicted to explain a major portion of a pixel structure in an organic EL display apparatus where the present invention is applied. On a main surface of a first substrate 100, a thin film transistor 139 comprising a poly-silicon semiconductor film PSI, gate electrode GT and source or drain electrode SD (source electrode in this figure) is formed. This thin film transistor 139 corresponds to the write switch in FIG. 2. Reference numeral 156 is an interlayer dielectric layer and 155 is a passivation layer.

The source electrode SD is connected to an anode 153 of an organic EL element. An organic EL layer 152 is deposited on the anode 153. Further, a cathode film 151 is deposited over the organic EL layer 152. This organic EL layer 152 is insulated from the anode 153 by a dielectric layer 154. On an internal surface of a second substrate 200, a moisture absorbent 202 is placed via an adhesive 201 for the main purpose of preventing the organic EL layer 152 from deteriorating due to moisture. A second substrate 200 is stacked on the first substrate 100. The light emitting elements and others on the main surface of the first substrate 100 are encapsulated by the second substrate 200 to shield them from the external environment. Sometimes, this second substrate 200 is called a shielding can.

Figure 12:
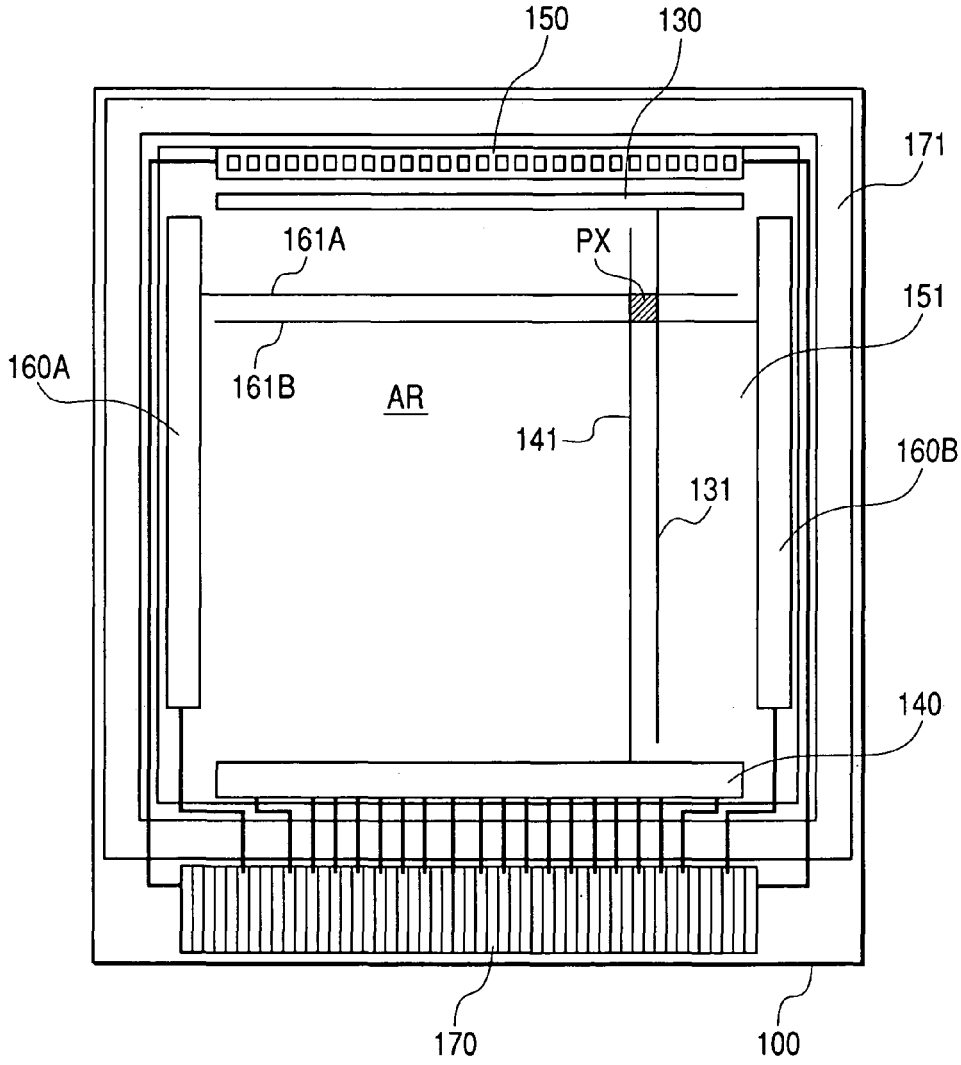
FIG. 12 is a schematic plan view illustrating layouts of functional portions of the first substrate included in the display apparatus explained with FIG. 11.

FIG. 12 is a schematic plan view illustrating layouts of functional portions of the first substrate included in the display apparatus explained with FIG. 11. This figure is depicted to explain how the individual functional parts are arranged on the first substrate. The first substrate 100 has at the central portion thereof a display area AR which occupies the most of the substrate. In this display area AR, the above-described organic EL display elements are arranged in a matrix. In FIG. 12, scan line drive circuits 160A and 160B are formed respectively on the left and right sides of the display area. Scan lines are extended alternately from the scan line drive circuits 160A and 160B as represented by scan lines 161A and 161B. In addition, there is provided a data line drive circuit 140 on the lower side of the display area AR. Data lines are extended from the data line drive circuit 140 so as to intersect with the scan lines as represented by a data line 141.

Further, on the upper side of the display area AR, there is provided a current supply mother line 130 from which a current supply line 131 and other current supply lines are extended. In this configuration, one pixel PX is formed in a small area surrounded by the scan lines 161A and 161B, data line 141 and current supply line 131. In addition, the display area AR inside a sealing agent 171, the scan line drive circuits 160A and 160B, and the data line drive circuit 140 are coated by the cathode film 151. Note that the reference numeral 170 denotes a contact area where the cathode film 151 is connected with a cathode film wiring pattern (not shown) formed by a lower layer in the first substrate 100.

Note that the display apparatus structured or configured as described above with FIGS. 11 and 12 is an example. Needless to say, the display apparatus can also be configured in various other ways.

What is claimed is:

1. A display apparatus for displaying an image in accordance with an input display data, comprising:

a display having a plurality of display elements, said elements being arranged in a matrix;

a data line drive circuit for providing a data voltage in accordance with said input display data to said display elements via data lines; and a scan line drive circuit for providing a scan voltage to said display elements via scan lines in order to determine a line of said display elements to be driven;

wherein:

said data line drive circuit has a sweep voltage generation circuit and a switching circuit, said sweep voltage generation circuit generating a sweep voltage and a sweep voltage select signal, said switching circuit selecting a one-line display data of said data voltage or said sweep voltage and outputting a selected one as a data line drive signal, and provides every scan line said data line drive signal to said display elements via said data lines;

during one blanking period in which said data voltage is not provided to said display elements, said switching circuit selects said sweep voltage in accordance with said sweep voltage select signal; and said sweep voltage has a stepped waveform and varies based on an up and down count of a reference clock irrelevantly to said input display data and controls an on-time of each of said display elements along with said input display data, during said one blanking period.

2. The display apparatus according claim 1, wherein said data line drive circuit selects in turn a voltage of a voltage source common to said data voltage every scan line during said one blanking period in which said data voltage is not provided to said display elements irrelevantly to said input display data and thereby varies said sweep voltage every scan line during said blanking period.

3. The display apparatus according claim 2, wherein said data line drive circuit generates said sweep voltage during said one blanking period in which said data voltage is not provided to said display elements and reduces said sweep voltage of said voltage source common to said data voltage by a level of said sweep voltage from high to low and increases said sweep voltage of said voltage source by said level of said sweep voltage from low to high, every scan line during said one blanking period irrelevantly to said display data and thereby varies said sweep voltage every scan line during said one blanking period.

4. A display apparatus for displaying an image in accordance with an input display data, comprising:

a plurality of scan lines;

a plurality of data lines which are perpendicular to said scan lines;

a plurality of light emitting elements each of which is placed at a point where said scan lines intersect with said data lines;

a data line drive circuit for providing a data voltage to said light emitting elements via said data lines;

a scan line drive circuit for providing a scan voltage to said scan lines in order to determine a light emitting element to be driven of said light emitting elements; and a control circuit for controlling said data line drive circuit;

wherein:

said control circuit outputs said data voltage in accordance with said input display data to control said data line drive circuit so that said data line drive circuit outputs a data line drive signal;

said data line drive circuit has a sweep voltage generation circuit and a switching circuit, said sweep voltage generation circuit generating said sweep voltage and a sweep voltage select signal, said switching circuit selecting a one-line display data of said data voltage or said sweep voltage and outputting a selected one as said data line drive signal, and provides every scan line said data line drive signal to said light emitting elements via said data lines;

during one blanking period in which said data voltage is not provided to said light emitting elements, said switching circuit selects said sweep voltage in accordance with said sweep voltage select signal and outputs said sweep voltage; and said sweep voltage has a stepped waveform and varies based on an up and down count of a reference clock irrelevantly to said input display data and controls an on-time of each of said light emitting elements to be driven along with said input display data, during said one blanking period.

5. The display apparatus according to claim 4, wherein said sweep voltage varies with a value counted down to "0" from initial value "n" of said up and down count and counted up to said initial value "n" of said up and down count again during said one blanking period in which said data voltage is not provided to said light emitting elements.

6. A display apparatus for displaying an image in accordance with an input display data, comprising:

a display having a plurality of pixels, each of said pixels having a light emitting element and a drive circuit to drive said light emitting element therein and being arranged in a matrix;

a data line drive circuit for providing a data voltage to said pixels via data lines; and a scan line drive circuit for providing a scan voltage to scan lines in order to determine a light emitting element to be driven;

wherein:

said data line drive circuit has a sweep voltage generation circuit and a switching circuit, said sweep voltage generation circuit generating said sweep voltage and a sweep voltage select signal, said switching circuit selecting a one-line display data of said data voltage or said sweep voltage and outputting a selected one as a data line drive signal, and provides every scan line said data line drive signal to said light emitting element via said data lines;

during one blanking period in which said data voltage is not provided to said pixels, said switching circuit selects said sweep voltage in accordance with said sweep voltage select signal and provides said sweep voltage to said pixels via said data lines;

said drive circuit disposed in each of said pixels drives said light emitting element according to said data voltage, and during said one blanking period, said drive circuit disposed in each of said pixels retains said data voltage, and makes said light emitting element in off state when said sweep voltage is higher than said retained data voltage, and makes said light emitting element in on state when said sweep voltage is lower than said retained data voltage; and said sweep voltage has a stepped waveform and varies based on an up and down count of a reference clock irrelevantly to said input display data during said one blanking period in which said data voltage is not provided to said light emitting element in each of said pixels.

7. The display apparatus according to claim 6, wherein said switching circuit in said data line drive circuit selects said one-line display data of said data voltage and said sweep voltage alternately in accordance with said sweep voltage select signal in a frame frequency of said input display data.

8. A display apparatus for displaying an image in accordance with an input display data, comprising:

a display having a plurality of display elements, said elements being arranged in a matrix;

a data line drive circuit for providing a data voltage in accordance with said input display data to said display elements via data lines; and a scan line drive circuit for providing a scan voltage to said display elements via scan lines in order to determine a line of said display elements to be driven;

wherein:

said data line drive circuit has a circuit for generating a sweep voltage and a sweep voltage select signal, selecting a one-line display data of said data voltage or said sweep voltage and outputting a selected one as a data line drive signal, and provides every scan line said data line drive signal to said display elements via said data lines;

during one blanking period in which said data voltage is not provided to said display elements, said data line drive circuit selects said sweep voltage in accordance with said sweep voltage select signal; and said sweep voltage has a stepped waveform and varies based on an up and down count of a reference clock irrelevantly to said input display data and controls an on-time of each of said display elements along with said input display data, during said one blanking period.

9. A display apparatus for displaying an image in accordance with an input display data, comprising:

a display having a plurality of pixels, each of said pixels having a light emitting element and a drive circuit to drive said light emitting element therein and being arranged in a matrix;

a data line drive circuit for providing a data voltage to said pixels via data lines; and a scan line drive circuit for providing a scan voltage to scan lines in order to determine a light emitting element to be driven;

wherein:

said data line drive circuit has a circuit for generating a sweep voltage and a sweep voltage select signal, selecting a one-line display data of said data voltage or said sweep voltage and outputting a selected one as a data line drive signal, and provides every scan line said data line drive signal to said light emitting elements via said data lines;

during one blanking period in which said data voltage is not provided to said light emitting elements, said data line drive circuit selects said sweep voltage in accordance with said sweep voltage select signal and provides said sweep voltage to said light emitting elements via said data lines;

said drive circuit disposed in each of said pixels drives said light emitting element according to said data voltage, and during said one blanking period, said drive circuit disposed in each of said pixels retains said data voltage, and makes said light emitting element in off state when said sweep voltage is higher than said retained data voltage, and makes said light emitting element in on state when said sweep voltage is lower than said retained data voltage; and said sweep voltage has a stepped waveform and varies based on an up and down count of a reference clock irrelevantly to said input display data during said one blanking period in which said data voltage is not provided to said light emitting element in each of said pixels.

* * * * *